US006446810B1

(12) United States Patent
Huang et al.

(10) Patent No.: US 6,446,810 B1
(45) Date of Patent: Sep. 10, 2002

(54) TABLESS SELF-OPENING BAG PACK

(75) Inventors: Daniel C. Huang; Frank F. J. Huang, both of Tustin, CA (US)

(73) Assignee: Durabag Co., Inc., Tustin, CA (US)

( * ) Notice: Subject to any disclaimer, the term of this patent is extended or adjusted under 35 U.S.C. 154(b) by 0 days.

(21) Appl. No.: 09/740,347

(22) Filed: Dec. 18, 2000

(51) Int. Cl.[7] ..... B65D 33/14
(52) U.S. Cl. ..... 206/554; 383/9
(58) Field of Search ..... 206/554; 383/8, 383/9, 37

(56) References Cited

U.S. PATENT DOCUMENTS 5,248,040 A * 9/1993 DeMatteis et al. ..... 206/554
5,307,935 A * 5/1994 Kemanjian ..... 206/554
5,333,730 A * 8/1994 Boyd ..... 206/554
5,464,098 A * 11/1995 Tseng et al. ..... 206/554
5,845,779 A * 12/1998 Wilfong, Jr. et al. ..... 206/554
5,881,882 A * 3/1999 Fletcher et al. ..... 206/554
6,079,877 A * 6/2000 Chew ..... 383/8

* cited by examiner

*Primary Examiner*—Bryon P. Gehman
(74) *Attorney, Agent, or Firm*—Christie, Parker & Hale, LLP

(57) ABSTRACT

A pack of self-opening bags with a front, rear, and co-joined side walls, with front and rear tabs extending from top edges of the front and rear walls. The tabs have a curved aperture slits therein, and the tabs are frangibly adhered together with contact adhesive. The slit has a main cut section, a first curved end section at one end, and a second curved end section at the opposite end. The first curved section has a curve that extends upwardly and inwardly from the main cut section. The second curved section has a substantially semi-circular curve that extends from the main cut section in a direction towards the bottom edge of the tab and has an end that is substantially perpendicular to and adjacent the main cut section. In one embodiment, the first curved section is dashed.

10 Claims, 7 Drawing Sheets

FIG. 1
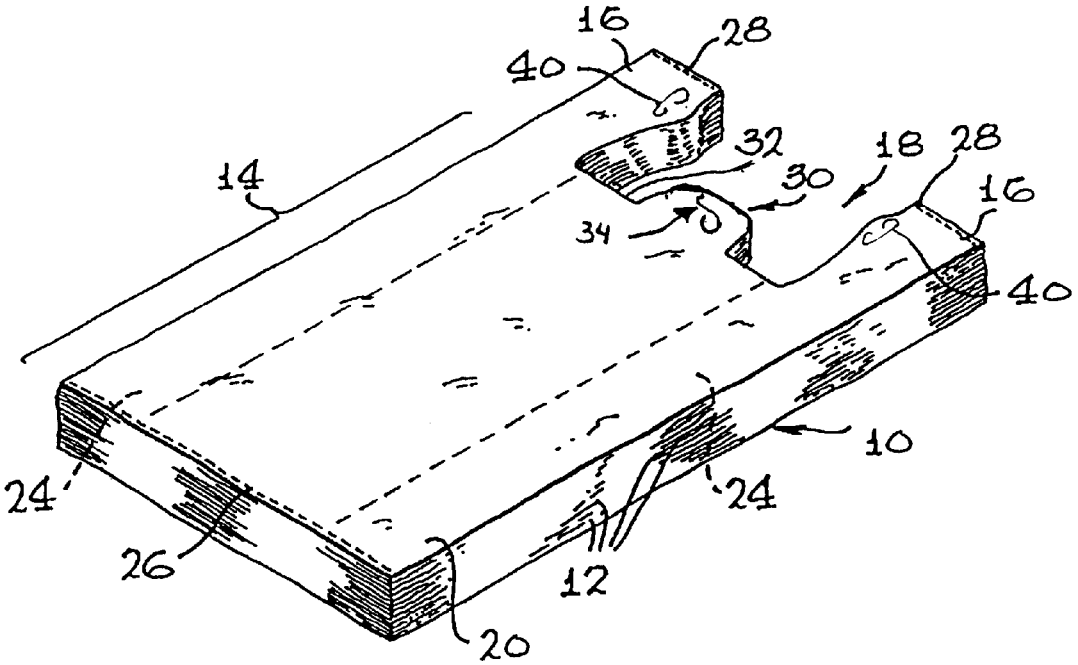
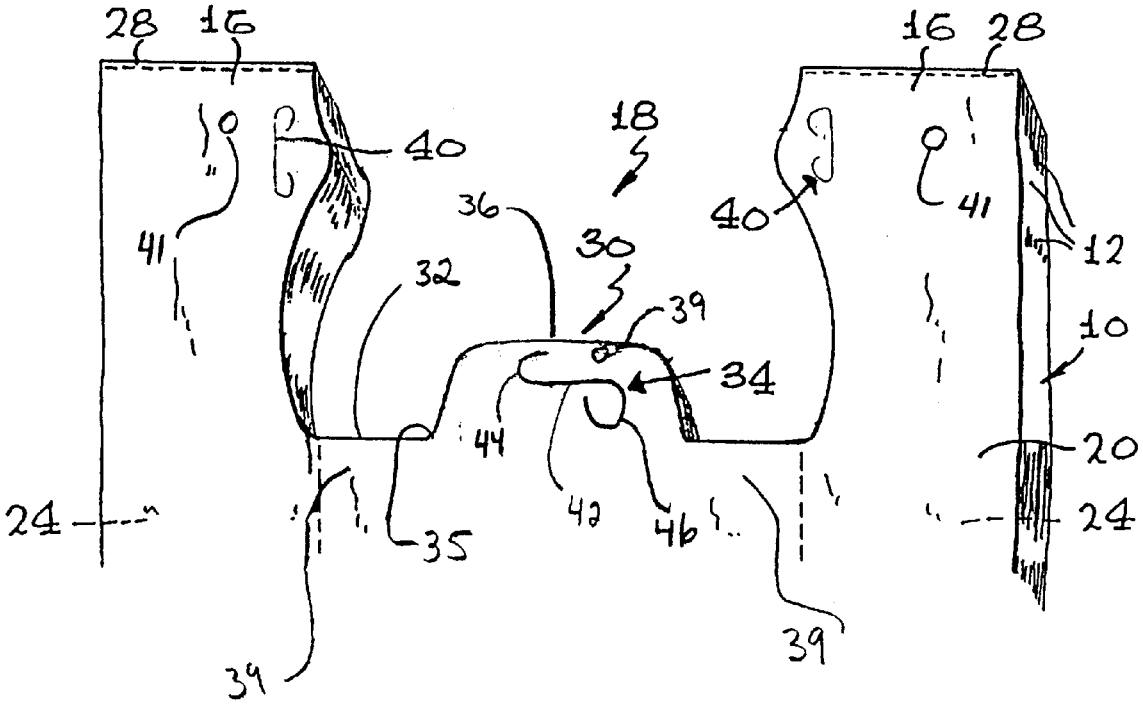
FIG. 2

FIG. 6
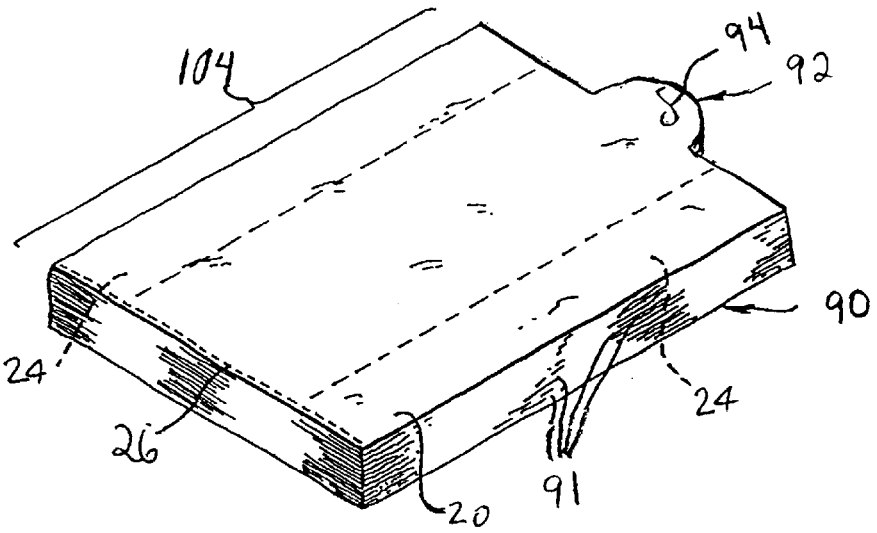
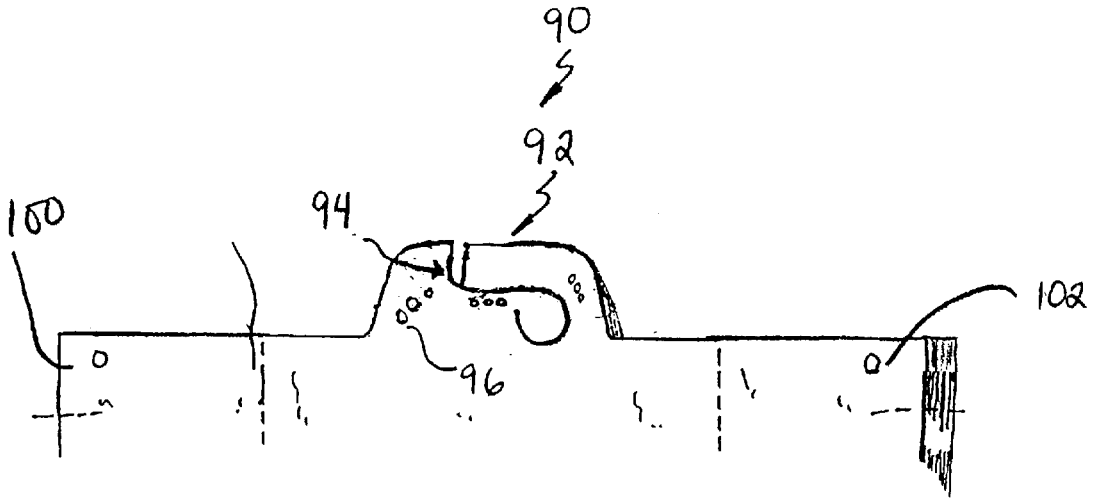
FIG. 7

FIG 9
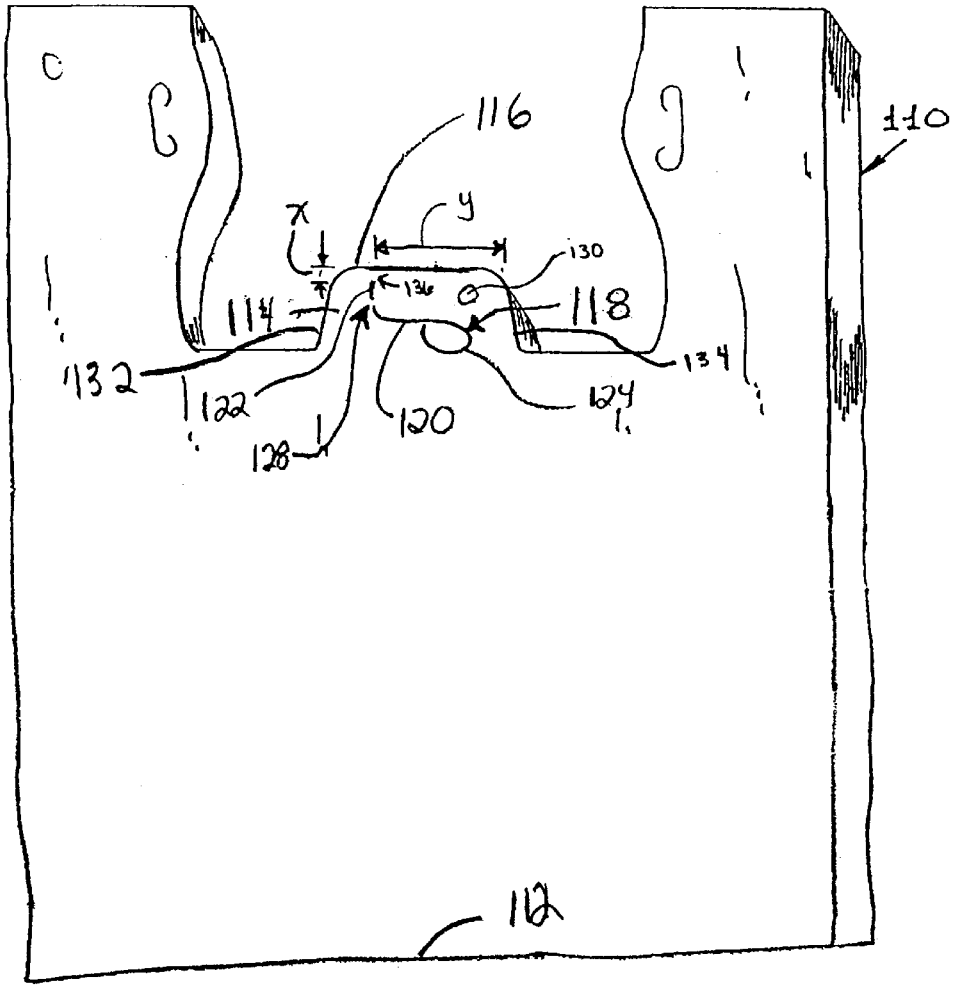
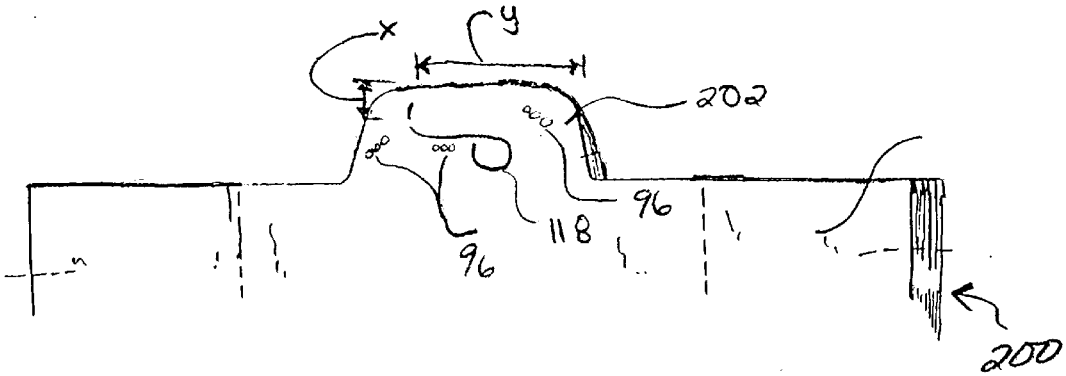
FIG. 10

TABLESS SELF-OPENING BAG PACK

FIELD OF THE INVENTION

This invention relates to plastic bags, and more particularly to a pack of tabless T-shirt bags or merchandise bags, trash bags, and the like made preferably of polyolefins, and method of manufacturing same, which can be used with or without bagging racks and which provide for reliable self-opening of the bags as each bag is removed from the pack of bags.

BACKGROUND OF THE INVENTION

Since the mid-1980's, the use of plastic shopping bags has grown dramatically due to the great advantage plastic bags have over bags made of other materials, such as paper. Many types of plastic bags are made of low or high density polyethylene (LDPE and HDPE, respectively), but can be made of any of the polyolefins. LDPE and HDPE bags are stronger, lighter and much more compact to store than paper bags, saving valuable storage space at the merchants' check-out counter and storage areas. These attributes also make these bags less expensive to transport. LDPE and HDPE bags can be manufactured and sold at a fraction of the cost of competing paper bags, making them the bags of choice for merchants. LDPE and HDPE bags are also actually more environmentally friendly than paper bags since they require about 70 percent less energy to manufacture than competing paper bags and are readily recyclable, and when not recycled, are non-toxic when incinerated or disposed of in landfills.

Many groceries stores and other merchants now use a style of plastic bag to bag groceries and other merchandise commonly referred to as T-shirt bags. T-shirt bags are pleated bags which are closed, by heat sealing, at a bottom edge, and have a pair of integral loop handles extending upwardly to define an open mouth of the bag therebetween. T-shirt bags usually have a central tab that extends from front and rear walls of the bag. Each of the front and rear walls have a central tab that extends from the walls, respectively. The central tabs have aligned apertures into which bagging racks are received.

Because high density polyethylene (HDPE) has a greater resistance to stretching and deformation than LDPE plastic, HDPE plastic is generally used for making T-shirt bags, although LDPE and other polyolefins can also be used. T-shirt bags are normally provided in packs of aligned bags and these packs of bags are usually used in conjunction with bagging racks.

T-shirt bags are generally manufactured using a continuous tube of HDPE plastic, or other plastic material having the desired color, thickness, and diameter, formed on a extrusion machine. The continuous plastic tube is passed over rollers to roll the continuous plastic tube onto a spool.

The newly formed continuous plastic tube is usually subjected to corona surface treatment, if the bags to be formed from the continuous tube of HDPE are to be printed on one or both sides. It has been found that corona surface treatment, or other known methods to electrically and chemically change the entire outer surface of the continuous plastic tube, contributes somewhat to the self-opening feature of applicants' plastic bag pack system.

After being corona surface treated and rolled (if the bags might be printed), the roll of continuous plastic tube is unrolled and pleated on a pleating machine. A bagging machine then heat seams and cuts sections of the pleated tube at top and bottom edges to form closed and flattened pleated bags of a desired length and width, with the pleated sides being at both sides of the flattened pleated bags. These sections are often referred to as pillowcases. The pillowcases are eventually stacked in aligned stacks.

Thereafter, hydraulic die cutting or other cutting methods are utilized to remove material at the stacked pillowcases' upper portions to form the handles and tab portions. Each loop handle has four layers of plastic material since they are cut out from the pleated side portions of the bag.

Despite the many advantages HDPE T-shirt bags have over paper bags, they are not self-standing like thicker and stiffer paper bags with a discreet flat bottom. This is due to their relatively thin and flexible material. In grocery stores settings, where quick and easy loading of bags is desirable, packs of T-shirt bags are generally supported on a bagging rack as merchandise is loaded into the bags to overcome the lack a of self-standing ability.

The packs of T-shirt bags suffer from drawbacks. Prominent among these drawbacks include the lack of a convenient and easy to manufacture self-opening feature, to eliminate the need for the box person to struggle to open up each bag in the pack of bags.

In order to prepare a T-shirt bag for loading with merchandise, it is desired that only the first layer of the bag material of the top bag are pulled away from the pack, thereby opening just the top bag. Since the HDPE material is very thin, typically between 0.5 and 1 mil thick (0.0005 and 0.001 inches), it is sometimes difficult for the checkout clerk or box person to grasp just the top layer of bag material. One can often see a sponge or source of tacky material, such as a glue stick, retained at the top of bagging racks, with which the checkout clerk or box person can dampen his or her fingers to aid in grasping just the top layer of material of the bag. However, this takes additional time and effort in the bagging process. This cycle has to be repeated with each successive bag to be loaded.

In addition, the bag packs systems typically leave waste "books" of heat bonded central tabs on the bagging rack. These books accumulate on the bagging rack and are generally thrown out. In those styles of packs of bags which employ a central tab slit through their central tabs for mounting the pack of bags on a tab receiving hook of a bagging rack, it is sometimes difficult to engage the slitted central tab with the tab receiving hook.

There are also so-called "tabless" designs, in which no portion of the bag is left on the bagging rack. In these bag designs, each bag will tear through a suspension aperture completely as each bag is removed.

Existing tabless bag designs that are provided with a self-opening feature utilized frangible bonding to cause each bag to open. However, use of frangible bonding as a self-opening feature can be problematic because the strength of the bond formed depends on several factors, including the thickness of the plastic film, the degree of corona treatment, the size and shape of the die used to form the areas of frangible bonding, the pressure applied to the dies, and static changes in the bag materials. While adhesive have been used to create a self-opening feature in tabbed bag designs, use of adhesive in a flapless design is unknown to the inventor. Use of adhesive in the central tabs of packs of bags would be particularly useful to assure self-opening inasmuch as a pulling force close to the tearing slit will ensure that the bag will reliably open.

SUMMARY OF THE INVENTION

It is desirable to have a pack of plastic bags which can be easily manufactured, yet which provides for reliable self-opening of each bag of the pack of bags, does not leave a book of plastic tabs on the bagging rack, can be easily placed on a bagging rack, and does not tear the lower portion of the bag.

A pack of self-opening plastic bags for use with a bagging rack has a mouth for receipt of merchandise. Each plastic bag in the pack of bags has a mouth tab portion between its two upwardly extending handles. The mouth tab portions extend from front and rear walls along sides of the mouth. Through the stack of bag, in the mouth tab portion is a curved aperture slit for receiving a bagging pack hook member of a bagging rack. The curved aperture slit has a main cut section that is substantially parallel with the bottom edges of the walls, and two curved end sections at respective ends of the main cut section. One end section curves towards a top edge of the tab portion, and another end section curves in an opposite direction and wraps back under the main section until it is substantially perpendicular to and adjacent the main cut section. In one embodiment, the first curved section is dashed.

Contact adhesive bonding is preferably utilized near the curved aperture slit. The handles also have holes for use in suspending the pack of self-opening bags on the bagging rack. Due to the adhesive bonding between adjacent bags, as an outermost bag is removed from the pack of bags on the bagging rack, the next adjacent bag in the pack of bags automatically self-opens into an open position for loading with merchandise.

BRIEF DESCRIPTION OF THE DRAWINGS

FIG. 1 is a perspective view of a pack of self-opening T-shirt bags of the invention;

FIG. 2 is a fragmentary perspective view of an upper area of one embodiment of the pack of bags of FIG. 1, shown before the pack of bags is loaded on a bagging rack;

FIG. 6 is a perspective view of a pack of self-opening merchandise bags of the invention;

FIG. 7 is a fragmentary perspective view of an upper area of one embodiment of the pack of merchandise bags of FIG. 6;

FIG. 9 is a fragmentary perspective view of another embodiment of a pack of T-shirt bags, shown before the pack of bags is loaded on a bagging rack;

FIG. 10 is a fragmentary perspective view of an upper area of another embodiment of the pack of merchandise bags, shown before the pack of bags is loaded on a bagging rack.

DETAILED DESCRIPTION OF THE INVENTION

Figure 3:
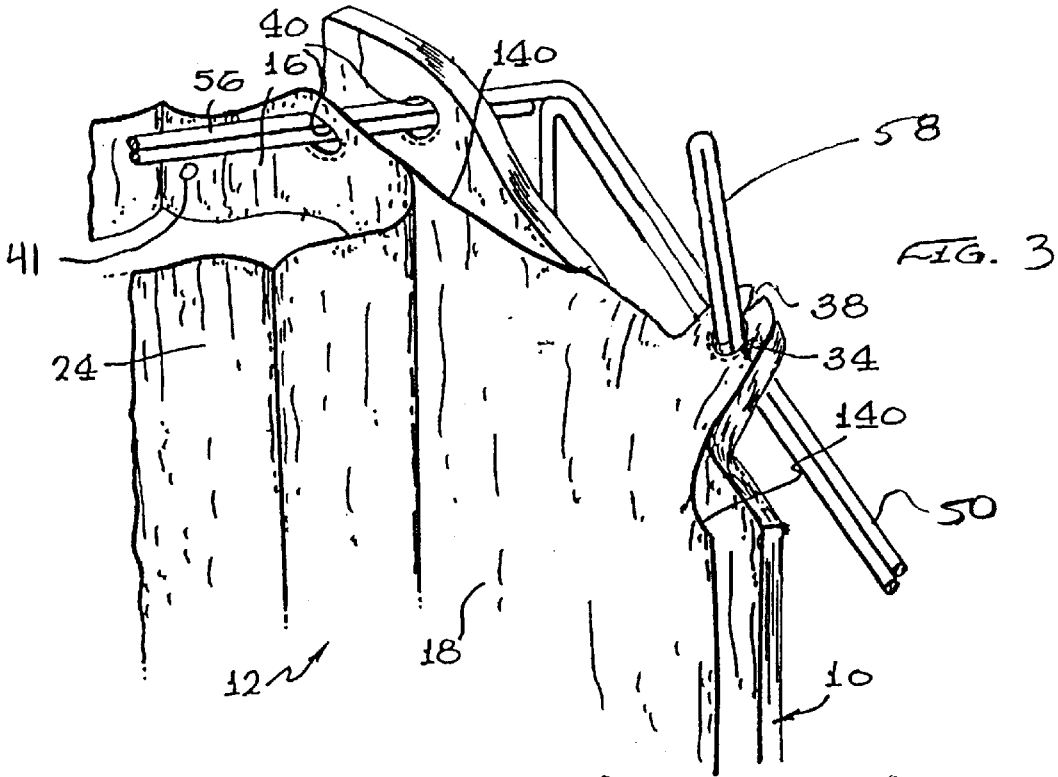
FIG. 3 is a partial perspective view of the one embodiment of the pack of bags of FIG. 1 hanging on the bagging rack, as a topmost bag is first opened up for loading with merchandise and released from the pack of bags.

Referring now more specifically to the drawings, reference numeral 10 designates the self-opening bag pack formed in accordance with the invention of multiple individual bags 12. The manufacturing process employed to manufacture the pack of self-opening bags 10 of the invention is similar to that used to manufacture conventional T-shirt bags. As shown in FIGS. 1 to 5, each individual bag 12 has a lower body portion 14, a front wall 20, a rear wall 22, pleated side walls 24 joining together the front and rear walls, and two loop handles 16 extending from the lower body portion 14. The loop handles 16 each extend from a top edge 32 of the front wall 20 and couple to the top edge 32 of the rear wall 22.

The T-shirt bags 12 are sealed together at their bottom edges 26 to form the lower body portion 14 and at their upper edges 28 to form the loop handles 16. Heat seaming is the preferred method of sealing the bottom and upper edges 26 and 28 of the bags 12, but other means can be employed, if desired.

In between the two loop handles 16 and the front and rear walls 20, 22 is a mouth 18 for receiving items into the bag 12. A mouth tab portion 30 extends from top edges 32 of both the front and rear walls 20 and 22 between the two loop handles 16. The tab portions 30 each have a top edge 36, and a bottom edge 35 that couples the tab portions 30 to the respective top edges 32.

Each mouth tab portion 30 in the embodiment of FIGS. 1 to 5 has a curved aperture slit 34. As will be discussed further below, these curved aperture slits 34 are used to suspend the pack of bags 10 on a bagging rack 50. A slit 38 is made at the upper portion of the tab portion 30 when the bag is opened up on the bagging rack 50. The slit 38 extends from the top edge 36 and communicates with the curved aperture slit 34, as described in more detail below.

Each curved aperture slit 34 has a main cut section 42 that is preferably substantially parallel with the bottom edges 26, a first curved cut section 44 coupled to one end of the main cut section, and a second curved cut section 46 coupled to an opposite end of the main cut section. The first section 44 preferably curves to extend from the main cut section in a direction upwardly and inwardly from the main cut section and towards the top edge 36 and center of the tab 30. The slit 38 extends from an end of the first curved section 44 to the top edge 36 of the tab 30.

The second section 46 is substantially curved and extends from the main cut section 42 in a direction towards the bottom edge 35 of the tab portion 30, and then back upwardly in a substantially vertical orientation.

Near the curved aperture slit 34 spots of contact adhesive 39 are applied between the front and rear walls of adjacent bags in the bag pack and frangibly bond together adjacent layers of the plastic material of the bags 12 in the pack of self-opening bags 10. The spots of contact adhesive 39 provide a self-opening feature of the pack of bags 10, as discussed in more detail below.

The pack of self-opening bags 10 also have handle holes 40 passing through the handles 16 for use in suspending the pack of self-opening bags 10 on the bagging rack 50. These handle holes 40 have areas of frangible cold pressure bonding 41 and/or spots of contact adhesive near the handle holes 40. The frangible bonds/contact adhesive retain the layers of plastic material of the handles 16 of the pack of bags 10 in stacked alignment.

Figure 5:
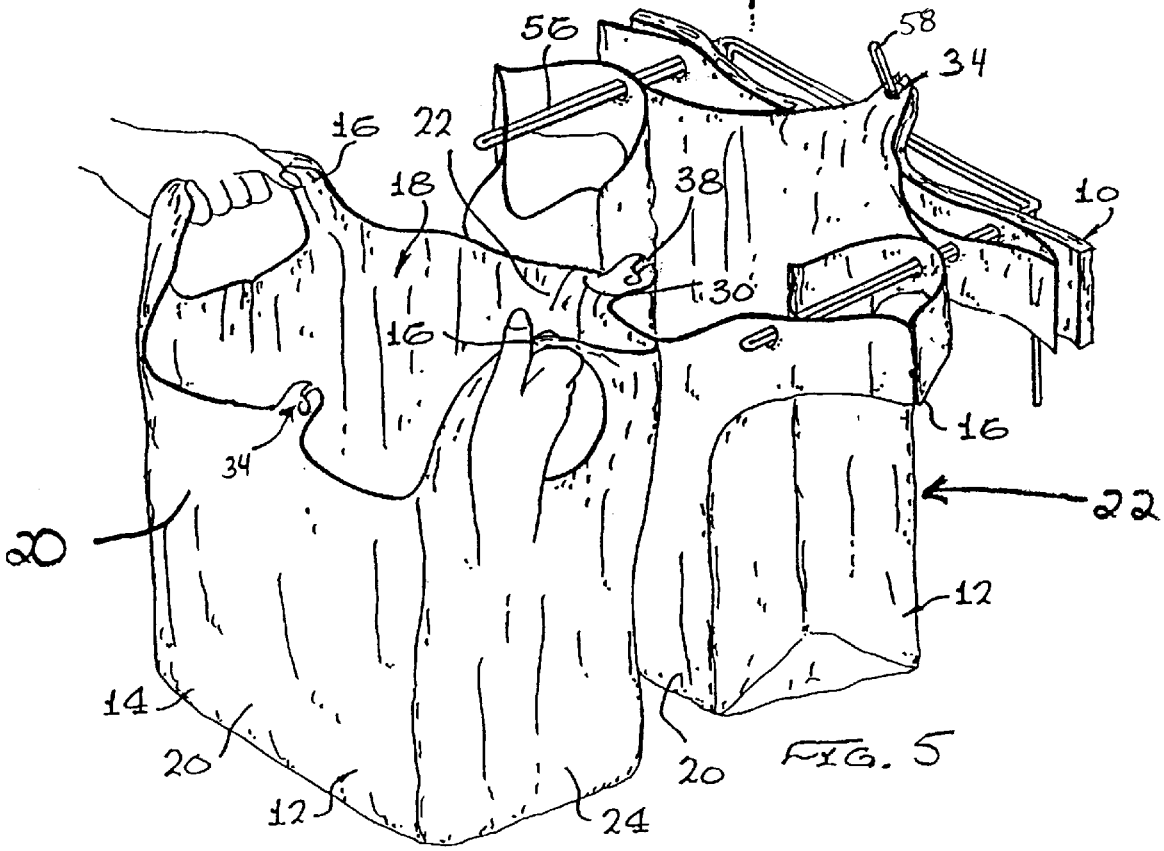
FIG. 5 is a further perspective view of the bag and pack of bags of FIG. 4 as the top bag is removed from the bagging rack and the next bag is automatically readied for loading.
Figure 4:
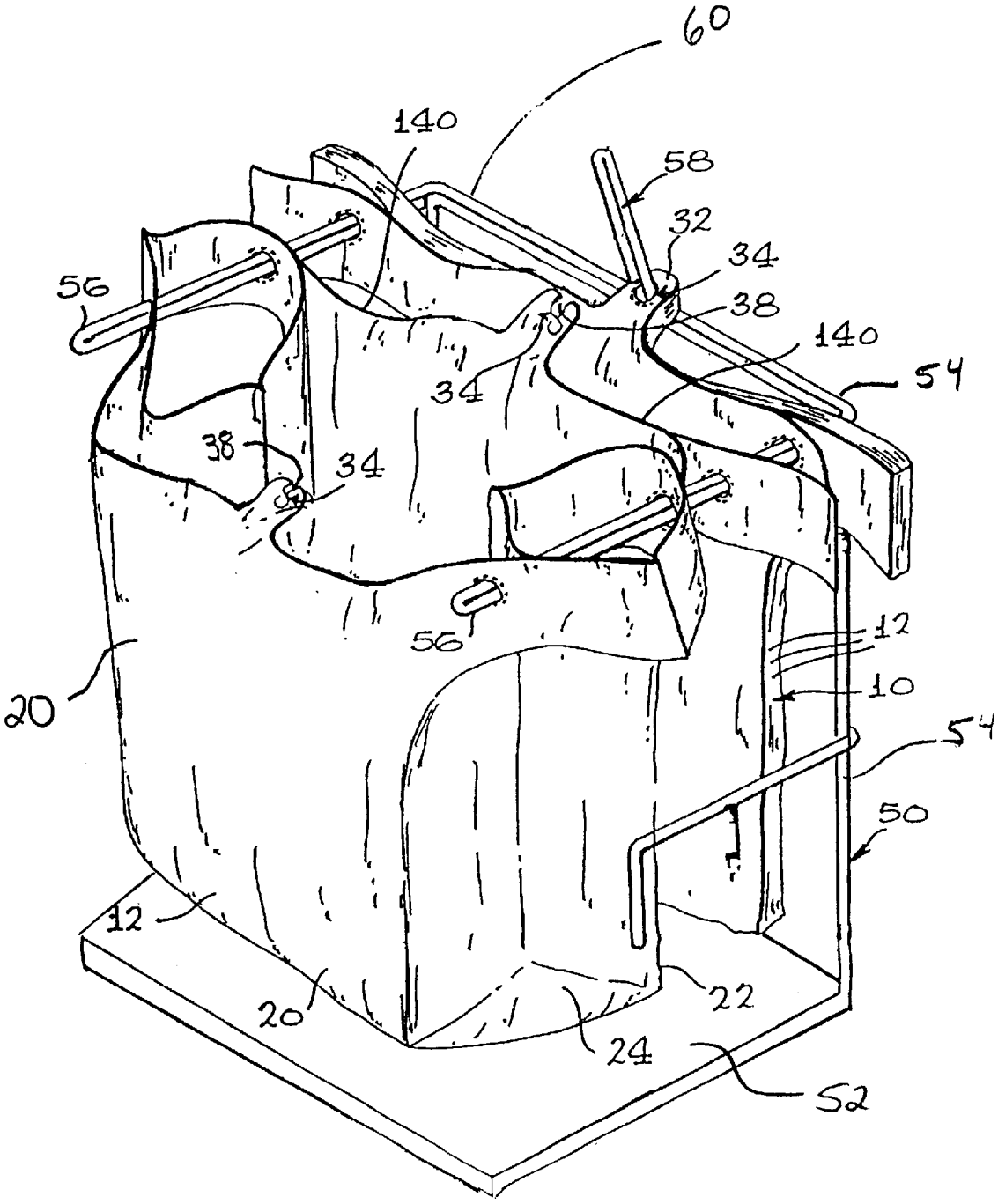
FIG. 4 is a perspective view of the bagging rack loaded with bags of FIG. 1, shown with the topmost bag of the pack of bags torn free from the tab hook of the bagging rack and opened up for loading with merchandise.

The pack of self-opening bags 10 is designed to be used in conjunction with the bagging rack 50, such as that shown in FIGS. 3 to 5. The bagging rack 50 has a support base 52, a support back 54 with a top edge 60 and two bag pack handle suspension arms 56 extending from the top edge 60 and over the support base 52. A bagging pack hook member 58 extends from the support back 54 over the support base 52 and is acutely angled away from the support base and back. The bagging rack hook member 58 is positioned approximately midway on the top edge 60 between the two bag pack handle suspension arms 56.

The pack of self-opening bags 10 is retained on the bagging rack 50 through receipt of the mouth tab portion 30 onto the hook member 58. Referring to FIGS. 3 to 5, the pack or packs of self-opening bags 10 of FIG. 1 are placed on the bagging rack 50 by passing the handle holes 40 in the handles 16 over the bag pack handle suspension arms 56 of the bagging rack 50 and then engaging the curved aperture slits 34 of the mouth tab portion 30 with the bagging rack hook member 58.

After loading the pack or packs of self-opening bags 10 on the bagging rack 50, a checkout clerk or box person first grasps only the front wall 20 of the outermost bag 12 and pulls the bag toward himself. The front wall 20 of the outermost bag 12 is torn free from the pack of self-opening bags 10 at its mouth tab portion 30. In particular, the slit 38 formed by the hook member 58 ripping through the mouth tab portion 30. The ripping through the tab portion 30 happens prior to the separation of adhesively bonded together bags because it takes less force to rip the tab portion than to break the adhesive bonding 39. As a result, the rear wall 22 of the outermost bag 12 stays attached to the bagging hook member 58. While the adhesive 39 is near the tearing slit 34, adhesive can be placed lower on the tab portion 30 or below the tab and below the mouth on the upper portion 39 of the bag pack.

After the outermost bag 12 is loaded with the merchandise through the mouth 18, its handles 16 are disengaged from the bag pack handle suspension arms 56 of the bagging rack by pulling the bag 12 away from the support back 54 of the bagging rack 50. By virtue of the bonding 39, 41, and slight adhesion between adjacent layers of plastic material, the front wall 20 and the side walls 24 of the next bag 12 adjacent the outermost bag 12 in the pack of self-opening bags 10 are pulled with the loaded bag 12 as shown in FIG. 5.

The next bag 12 automatically opens its mouth 18 without any need for the checkout clerk or box person to grasp the material of the front wall 20 of the adjacent bag 12. Slight further pulling of the outermost bag 12 by the box person, along with the load of the merchandise facilitates separation of the outermost bag 12 from its adjacent (next) bag 12. The adjacent bag 12 remains with its mouth 18 open in the bagging rack 50 because it still is frangibly bonded along its rear wall to another adjacent bag on a side opposite the outermost bag 12. Thereafter, by merely withdrawing consecutive bags from the top of the pack of self-opening bags 10, the adjacent bags 12 open up without the box person needing to manually and individually disconnect the front wall 20 of the outermost bag 12.

As best shown in FIGS. 3 to 5, when the outermost bag 12 is pulled to disengage from the pack of self-opening bags 10, most of the pulling tension is delivered along the top edges 35 of the bag's mouth 18 to the top edge 36 of the tab portion 30. This pulling tension along with the adhesive bonding 39, 41 causes the rear wall 22 of the outermost bag 12 along with the front wall 20 of the adjacent bag 12 to tear free from the pack of self-opening bags 10 at their mouth tab portions 30. Accordingly, each tab portion tears to form the tearing nick 38, typically leaving no portion of the bag 12 on the bagging rack 50.

For the tension placed on the tab portion, the direction of failure along the plastic bag tends to extend in a direction that is tangent to ends of the aperture slit. In particular, when the tab portion is tensioned, the tab portion tears from the end of the first curved section 44 towards the top edge 36 of the tab portion 30 to form the slit 38. Similarly, when the area around the second curved section 46 is tensioned, the tab portion 30 tears from the end of the second curved section to the main section. Accordingly, when the tab portion is tensioned, the plastic bag is usually torn in a direction opposite the lower portion 14. This limits the possibility of tearing the lower portion 14 of the bag.

FIGS. 6 and 7 show an embodiment of a self-opening bag pack 90, wherein the pack 90 has merchandise bags 91. The bags 91 are substantially the same shape and have substantially the same features as the bags 12 of FIG. 1. The main difference is that the bags 91 do not have handles similar to handles 16 of FIG. 1. The merchandise bags 91 each have a mouth tab portion 92 with a curved aperture slit 94 and an adhesive bonding 96. The spots of adhesive bonding 102 are positioned along top outer edges 100 of the bag 91. A bagging rack (not shown) for use with this embodiment is similar to that used with the previous embodiments, except there are no suspension arms for receipt of handles. Each bag 91 has a lower portion 104 that is similar to the lower portion 14 described with regard to FIG. 1. Also, the mouth tab portion 92 is similar to the mouth tab portion 30.

Figure 8:
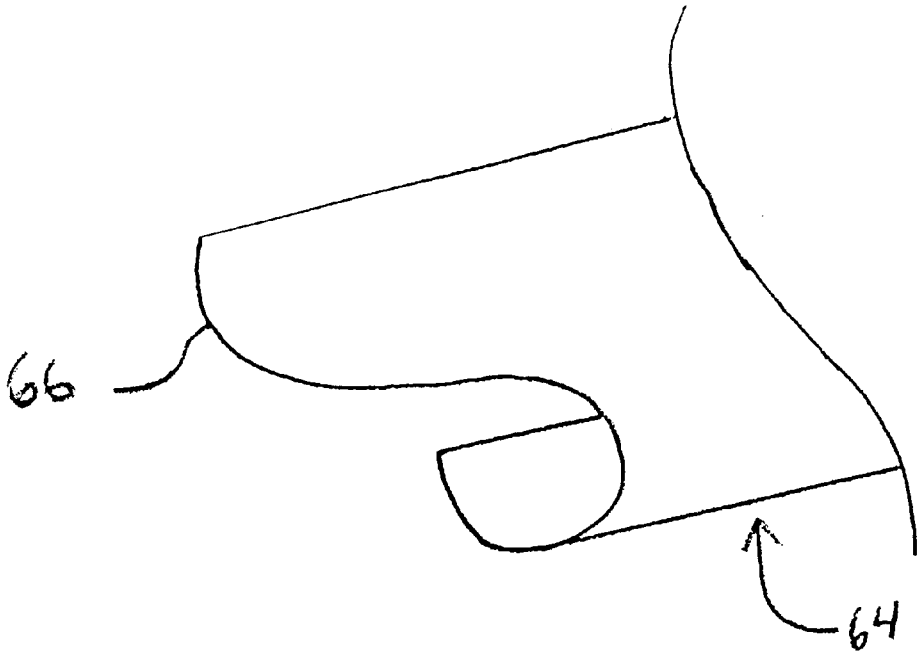
FIG. 8 is a perspective view of a blade used to form curved aperture slits for the embodiments of the packs of T-shirt bags of FIG. 1 and the merchandise bags of FIG. 6.

FIG. 8 illustrates a blade 64 used to form the curved aperture slit 34 of the embodiment shown in FIGS. 1–2 and the aperture slit 94 of the embodiment shown in FIG. 7. Prior to being die cut, at least one spot of adhesive is applied to each bag as it is stacked into a pillowcase of bags. The spots of adhesive will preferably be applied in a location that will be in close proximity to aperture slit when formed. Standard contact adhesive spitters, available from a variety of manufactures can be used to apply the contact adhesive. Precise registration of the stack of pillowcase and precise placement and control of the amount of the adhesive is necessary, otherwise during the manufacturing process, the die blades may impinge on the adhesive and cause the die blade to become coated with adhesive and thereby cause problems. The adhesive can be of the releasable contact variety. The blade 64 has a curvilinear cutting portion 66. The blade 64 is pushed into the pack of bags and cuts out the curved aperture slits 34, 94 in the tab portions 30, 92.

When the blade 64 and the stack of bags 12, 91 are brought into contact with each other, the curvilinear cutting portion 66 cleanly cuts the curved aperture slits 34, 94. This adhesive bonding contributes to the self-opening feature of the pack of bags, and also helps ensure that the thusly formed pack of bags is retained in stacked alignment for easy loading onto the bagging rack. The degree of frangible bonding formed in the handles can be increased by enlarging the surface contact area of the leading edge of sleeve member 72, such as by increasing the thickness of the blunt sleeve member 70 and/or by increasing the die pressure exerted and the degree of corona treatment.

A blade (not shown) is also used to form the handle holes 40 and the surrounding area of frangible cold pressure bonding 41 in the area near the handle holes 40 for the embodiment of FIG. 1.

FIG. 9 illustrates another embodiment of a pack of T-shirt bags 110 which are substantially the same as T-shirt bags 12 in FIGS. 1 to 5, except for curved aperture slits 118 replacing curved aperture slits 34.

The T-shirt bag 110 has a bottom edge 112 and a tab portion 114. The tab portion 114 has a top edge 116 and a discontinuous curved aperture slit 118. Near the curved aperture slit 118 are areas of frangible adhesive bonding 130 similar to those of the embodiment of FIG. 1.

Each curved aperture slit 118 has a main cut section 120 that is substantially parallel with bottom edges 112 of the bag, a first discontinuous curved cut section 122 coupled to one end of the main cut section, and a second curved cut section 124 coupled to an opposite end of the main cut section. The first section 122 curves to extend from the main cut section in a direction that is substantially perpendicular to the main cut section and towards the top edge 116 of the tab portion 114. The first section 122 is dashed, having a discontinuity 128 in the slit 118, as described in more detail below. An end of the first section 122 corresponds to a first end 136 of the aperture slit 118.

The second section 124 is shaped as a semi-circle. The second curved section 124 curves to extends from the main cut section 120 in a direction towards the bottom edge 112 of the tab portion 114. The second curved section 124 has an end that is substantially perpendicular to and adjacent the main cut section.

The discontinuity 128 in the first section 122 makes the tearing of a nick (not shown in this embodiment) from the slit 118 to the top edge 116 of the tab portion 114 slightly more difficult. When the force is applied to the tab portion, the force is directed at tearing the nick. More force is used initially when the tear is started, but the force may be reduced after the tear is started. However, with the discontinuity 128, if the force is decreased after the initial tear, only the discontinuity 128 disappears (the slit 118 is then continuous). As a result, the force is again increased to a level sufficient to initiate the tearing from the end of the slit 118 to the top edge 116 of the tab portion 114.

As shown in FIG. 9, the tab portion 114 has a first side 132 adjacent the first curved section 122, and a second side 134 adjacent the second curved section 124. A distance "x" between the first end 136 of the aperture slit 118 and the top edge 116 of the tab is about 2 to 5 mm. A distance "y" between the second side 134 and the first end 136 of the aperture slit is about 5 to 8 cm. Generally, the greater the distances x and y, the greater the force that is applied to tear the tab to form the tearing nick (not shown) from the top edge 116 of the tab portion to the aperture slit 118.

FIG. 10 illustrates another embodiment of a pack of merchandise bags 200 which are substantially the same as the merchandise bags 90 of FIGS. 6 to 7, except for curved aperture slits 118 replacing the curved aperture slits 94. The bags 200 have tab portions 202 that each have the curved aperture slits 118 as previously described with respect to FIG. 9.

The self-opening mechanics for the embodiments of FIGS. 6–7, 9, and 10, including the frangible adhesive bonding, are substantially the same as for the embodiment of the packs of self-opening T-shirt bags illustrated in FIGS. 1–5, described above.

Figure 11:
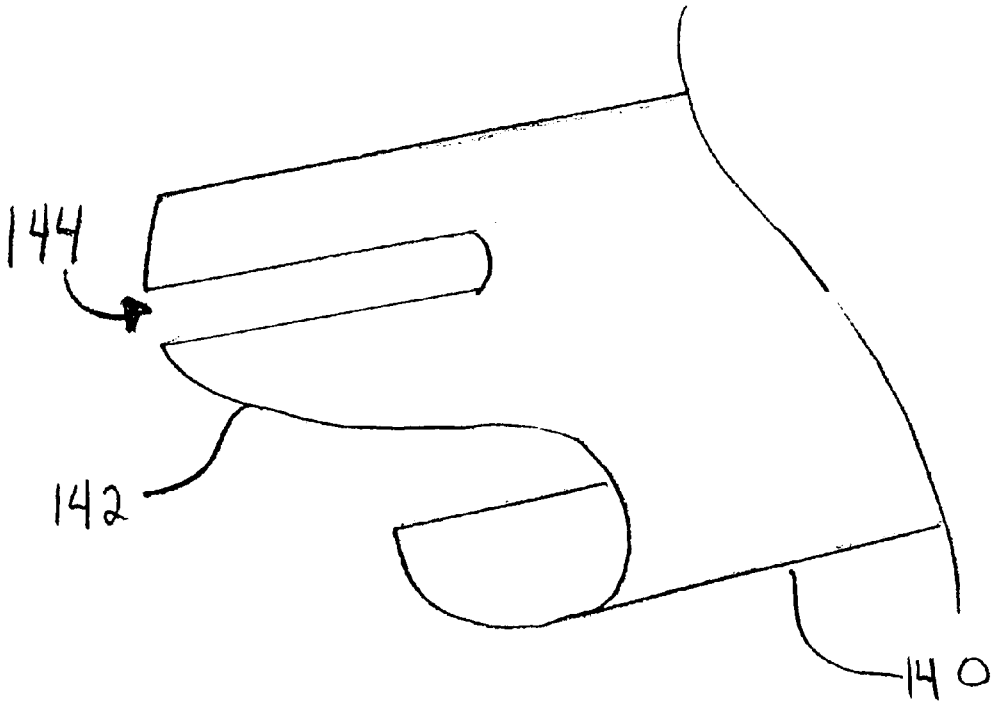
FIG. 11 is a perspective view of a blade used to form curved aperture slits for the embodiments of the packs of T-shirt and merchandise bags shown in FIGS. 9 and 10.
Figure 12:
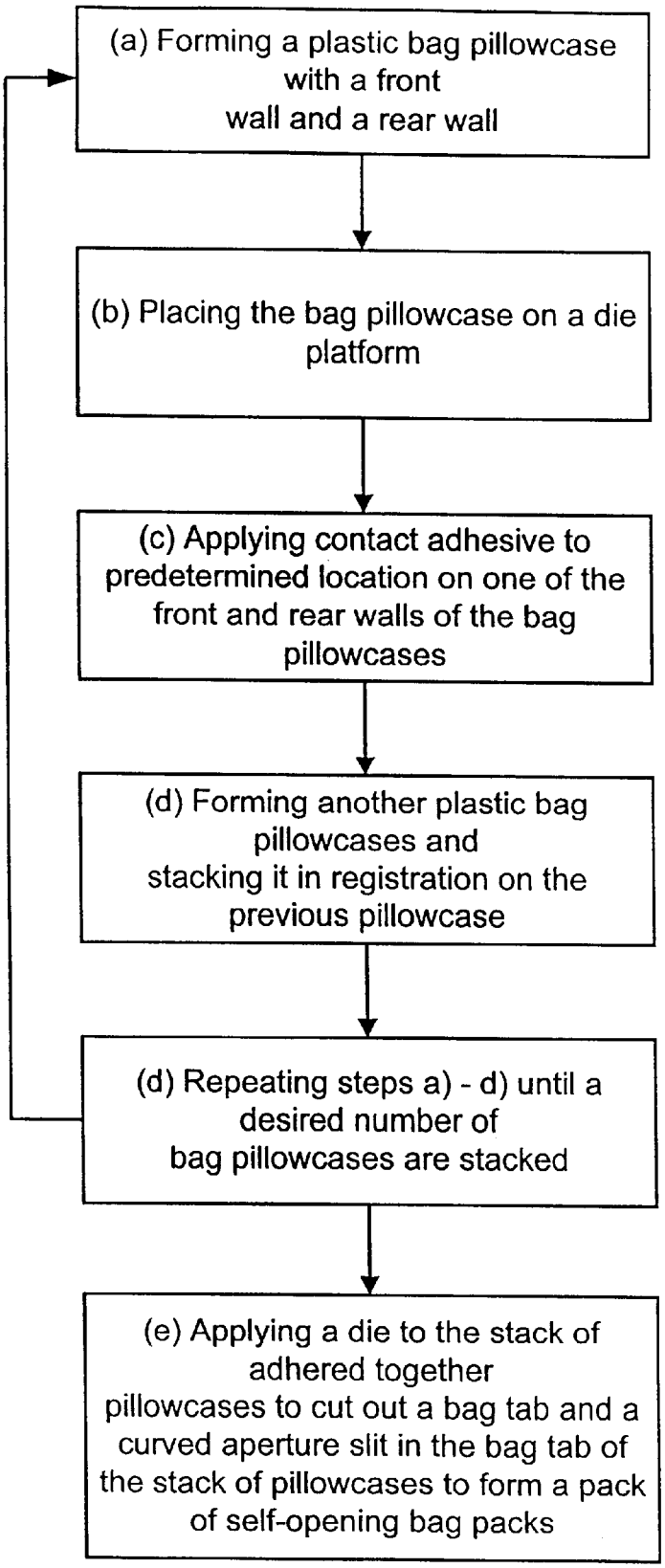
FIG. 12 is a flowchart showing the method of the invention.

FIG. 11 illustrates a blade 140 that is similar to the blade 64 described with reference to FIG. 8. The blade 140 is used to form the curved aperture slits 118 of FIGS. 9 and 10. The blade 140 is similar to blade 64, in that it has a similarly shaped curvilinear cutting portion 142. However, the blade 140 has a notch 144 that is used to make the discontinuity 128 in the aperture slit 118.

The drawings and the foregoing description are not intended to represent the only form of the invention in regard to the details of this construction and manner of operation. In fact, it will be evident to one skilled in the art that modifications and variations may be made without departing from the spirit and scope of the invention.

Although specific terms have been employed, they are intended in a generic and descriptive sense only and not for the purpose of limitation, the scope of the invention being delineated in the following the claims which follow.

What is claimed is:

1. A pack of tabless self-opening bags for suspension on a bagging rack, comprising:

a plurality of bags, each bag having a front wall having a bottom edge, a top edge, and side edges coupling the bottom edge and the top edge, wherein the top edge has a front tab that extends in a direction away from the bottom edge of the front wall;

a rear wall having a bottom edge, a top edge, and side edges coupling the bottom edge and the top edge, wherein the top edge has a rear tab that extends in a direction away from the bottom edge of the front wall, each tab having a bottom edge that couples the tab with the top edge of the respective wall, a top edge opposite the bottom edge, a first side and a second side, wherein the bottom edge of the front wall is coupled with the bottom edge of the rear wall;

side walls coupling the side edges of the front wall with the side edges of the rear wall;

the tabs each having aperture slits formed therethrough which correspond to each other, the aperture slits being for suspension of the bag packs, the aperture slits having a general S-shape with a central portion and a first end and a second end, the first end being curved and extending generally upwardly and the second end being hook-shaped and being directed downwardly, inwardly, then upwardly towards the central portion, the aperture slits being adapted to tear through at the first end directly to in edge of the tab upon removable of a bag from the pack of bags and to retain the torn-through tab on the walls of the bag; and wherein contact adhesive is placed on the tabs between adjacent bags at least above and adjacent to the aperture slits to create a self-opening feature in the bag pack.

2. The pack of tabless self-opening bags of claim 1, wherein the contact adhesive is further located below the top edge of the front and rear walls.

3. The pack of tables self-opening bags of claim 1, wherein the bags further have handles that extend upwardly from side edges and straddle the tabs, the handles have apertures formed therethrough.

4. The pack of tabless self-opening bags of claim 3, wherein at least one of contact adhesive and frangible pressure bonding is additionally located adjacent to the apertures in the handles.

5. The pack of tabless self-opening bags of claim 1 wherein the aperture slit is dashed along the curved first end at least once.

6. The pack of tabless self-opening bags of claim 1 wherein a distance between the first end of the aperture slit and the top edge of the tab is about 2 to 5 mm.

7. The pack of tabless self-opening bags of claim 1 wherein the distance between the first end of the aperture slit and the second end of the aperture slit is about 5 to 8 cm.

8. The pack of tabless self-opening bags of claim 1, wherein the contact adhesive is further placed immediately below the central portion of the aperture slits and between the first curved end of the aperture slit and the first side of the tab.

9. The pack of tabless self-opening bags of claim 8, wherein the contact adhesive is applied as a plurality of spots.

10. A pack of tabless self-opening bags for suspension on a bagging rack, comprising:

a plurality of bags, each bag having a front wall having a bottom edge, a top edge, and side edges coupling the bottom edge and the top edge, wherein the top edge has a front tab that extends in a direction away from the bottom edge of the front wall;

a rear wall having a bottom edge, a top edge, and side edges coupling the bottom edge and the top edge, wherein the top edge has a rear tab that extends in a direction away from the bottom edge of the front wall, each tab having a bottom edge that couples that tab with the top edge of the respective wall, a top edge opposite the bottom edge, a first side and a second side, wherein the bottom edge of the front wall is coupled with the bottom edge of the rear wall;

side walls coupling the side edges of the front wall with the side edges of the rear wall;

the tabs each having aperture slits formed therethrough which correspond to each other, the aperture slits being for suspension of the bag packs, the aperture slits having a first end and a second end, the aperture slits being adapted to tear through at the first end directly to an edge of the tab upon removable of a bag from the pack of bags and retain the torn through tab on the walls of the bag; and wherein contact adhesive is placed on the tabs between adjacent bags adjacent to the aperture slits to create a self-opening feature in the bag pack.

* * * * *

UNITED STATES PATENT AND TRADEMARK OFFICE

CERTIFICATE OF CORRECTION

PATENT NO. : 6,446,810 B1 
DATED : September 10, 2002
INVENTOR(S) : Daniel C. Huang and Frank F.J. Huang It is certified that error appears in the above-identified patent and that said Letters Patent is hereby corrected as shown below:

Column 8,
Line 51, replace “tables” with -- tabless --.

Signed and Sealed this

Twenty-fifth Day of February, 2003

JAMES E. ROGAN
*Director of the United States Patent and Trademark Office*